US008069751B2

(12) United States Patent
Barton

(10) Patent No.: US 8,069,751 B2
(45) Date of Patent: Dec. 6, 2011

(54) E-Z LID LIFTER

(76) Inventor: Darryl William Barton, White Mtn. Lake, AZ (US)

( * ) Notice: Subject to any disclaimer, the term of this patent is extended or adjusted under 35 U.S.C. 154(b) by 202 days.

(21) Appl. No.: 12/387,445

(22) Filed: May 4, 2009

(65) Prior Publication Data

US 2010/0275735 A1 Nov. 4, 2010

(51) Int. Cl.
*B67B 7/20* (2006.01)

(52) U.S. Cl. ..... 81/3.55; 81/3.09

(58) Field of Classification Search ..... 81/3.09, 81/3.4, 3.55

See application file for complete search history.

(56) References Cited

U.S. PATENT DOCUMENTS 1,176,615 A * 3/1916 Stempel ..... 81/3.09
1,429,452 A * 9/1922 Phillips ..... 81/3.09
1,661,333 A * 3/1928 Gurnett ..... 81/3.09
2,004,485 A * 6/1935 Brause ..... 81/3.09
2,031,420 A * 2/1936 Lebherz ..... 81/3.09
7,540,219 B1 * 6/2009 Shands ..... 81/3.4
2005/0193867 A1 * 9/2005 Haynes ..... 81/3.4

* cited by examiner

*Primary Examiner* — David B Thomas

(57) ABSTRACT

The "invention" is a unique device that has but one relevant purpose and that is to engage both regular and large mouthed mason jars that have been vacuum sealed with a "dome lid" (without a ring), thus attached by a user screwing the invention's two tiered body onto the selected mason jar. The top tier of the invention receives a regular mouthed mason jar while the lower tier receives a large mouthed mason jar. Once screwed onto the existing jar the user depresses the appropriate level leaf spring, thus inserting the associated lifting pin underneath the lip of the present dome lid and then, while holding the mechanism inward, the user unscrews the invention's body causing a counterclockwise and upward force on the dome lid via the lifting pin separating the dome lid from the mason jar, opening it.

2 Claims, 4 Drawing Sheets

E-Z LID LIFTER

BACKGROUND OF INVENTION

I, Darryl Barton have enjoyed home canning for many years but have always had a difficult time opening the sealed Mason jars. I would have to use silverware, countertops, and any other number of objects to pry the dome lid from the Mason jar, breaking the seal. Unfortunately, this process would deform or destroy the dome lids, chip the glass Mason jars and even spill the contents.

I realized that there must be any easier way to efficiently break the seal of the dome lid without marring the lids or chipping the Mason jar. And that easier way is the E-Z Lid Lifter.

On Sep. 17, 2008 I made a prototype and I've used it successfully since.

BRIEF SUMMARY OF INVENTION

E-Z Lid Lifter is a device that gently lifts the dome lid up and away from a sealed Mason jar that has gone through the canning process, thus breaking the vacuum seal and opening the jar.

The E-Z Lid Lifter accomplishes this by the User simply screwing the E-Z Lid Lifter onto a Mason jar, presses and holds the lifting pin button inward so that the lifting pin is depressed inward lightly against the Mason jar and under the lip of the dome lid. The body of the E-Z Lid Lifter is then unscrewed. As the E-Z Lid Lifter rises on the threads of the Mason jar the lifting pin slides along the underneath lip of the dome lid, lifting it, breaking the seal and opening the jar.

The E-Z Lid Lifter is designed to open both regular mouth Mason jars as well as wide mouth Mason jars.

The E-Z Lid Lifter also has a 1½ inch "finger hole" in the very top to allow the User to remove the dome lid from the E-Z Lid Lifter if a lose dome lid becomes stuck inside the body of the E-Z Lid Lifter, after removal. To use the finger hole, the user rescrews the E-Z Lid Lifter back onto the Mason jar, insert a finger or to into the hole and hold down the now loose lid and then unscrew the E-Z Lid Lifter.

Process of Manufacture: The body the E-Z Lid Lifter (1&2) should/can easily be made using high pressure plastic injection molding. The lifting pins (6&7) should be made of round stainless steel stock, measuring 3/16 inch wide and 3/16 inch long, to prevent rusting and the small leaf springs (4&5), measuring ½ inch wide and 1½ inch long, should be made of stainless steel as well and can be stamped out of suitable springy sheet metal and shaped so that the ends curve inward, creating a type of half moon shape.

The lifting pins (6&7), after being placed exact center of the leaf springs (4&5), the lifting pin (6&7) and the leaf springs (4&5) can be connected together using a spot weld and then the lifting pin/leaf spring assembly can be fitted on to the body of the E-Z Lid Lifter (1&2) by hand. The far ends of the leaf springs will then be settled into the retention ridges (9), so that the ends of the leaf springs can expand and retract while being depressed and released and will not detach from the body.

The holes, 13/64 inch (15&16) in which the lifting pins (6&7) will be inserted must be precisely positioned. The exact center of the holes are positioned as such, measuring from the inside, top of both the upper and lower body, where the top, outside of the dome lid (of a sealed Mason jar) will contact the inside, top of the body, down 7/32 inch and precisely centered on the peak of the upper layer of the threats on both the upper and lower portion of the body (1&2).

The E-Z Lid Lifter also has a 1½ inch "finger hole" (3) in the very top to allow the User to remove a dome lid from the E-Z Lid Lifter if a lose lid becomes stuck inside the body of the E-Z Lid Lifter, after the seal is broken.

DETAILED DESCRIPTION OF THE INVENTION

The E-Z Lid Lifter is a device that screws onto and opens sealed Mason jars, by lifting the dome lid from a vacuum sealed Mason jar, both regular and wide mouth jars.

The body of the E-Z Lid Lifter (1, 2¾ inch, inside diameter & 2, 3½ inch, inside diameter) upper and lower portions respectively, is comprised of two basic parts. The upper portion of the body is designed to screw on to and lift the dome lid from a regular mouth Mason jar, the lower portion of the body is designed to screw on to and lift the dome lid from a wide mouth Mason jar, thus opening the jars.

Both the upper and lower portion of the E-Z Lid Lifter (1&2) is hard plastic, injection molded into one piece.

Both the upper and lower portion of the body (1&2) have individual leaf spring (4&5, 1½ inches long and ½ inch wide)/lifting pins (6&7, 3/16 inch diameter and 3/16 inch long) assemblies. The lower lifting pin (6) lifts the dome lid from large mouth Mason jars and the upper lifting pin (7) lifts the lid from regular mouth jars.

The lifting pin (6) shown in figure #4, is shown without the E-Z lid lifter body to more clearly demonstrate the action of the lifting pins (6) motion which is counterclockwise and upward.

Both of the lifting pins (6&7) piston in and out of 13/64 inch holes (15&16) and are held outward, away from the Mason jar by small leaf springs, so that the E-Z Lid Lifter can be screwed onto the sealed Mason jar without interference from the lifting pins.

Figure 1:
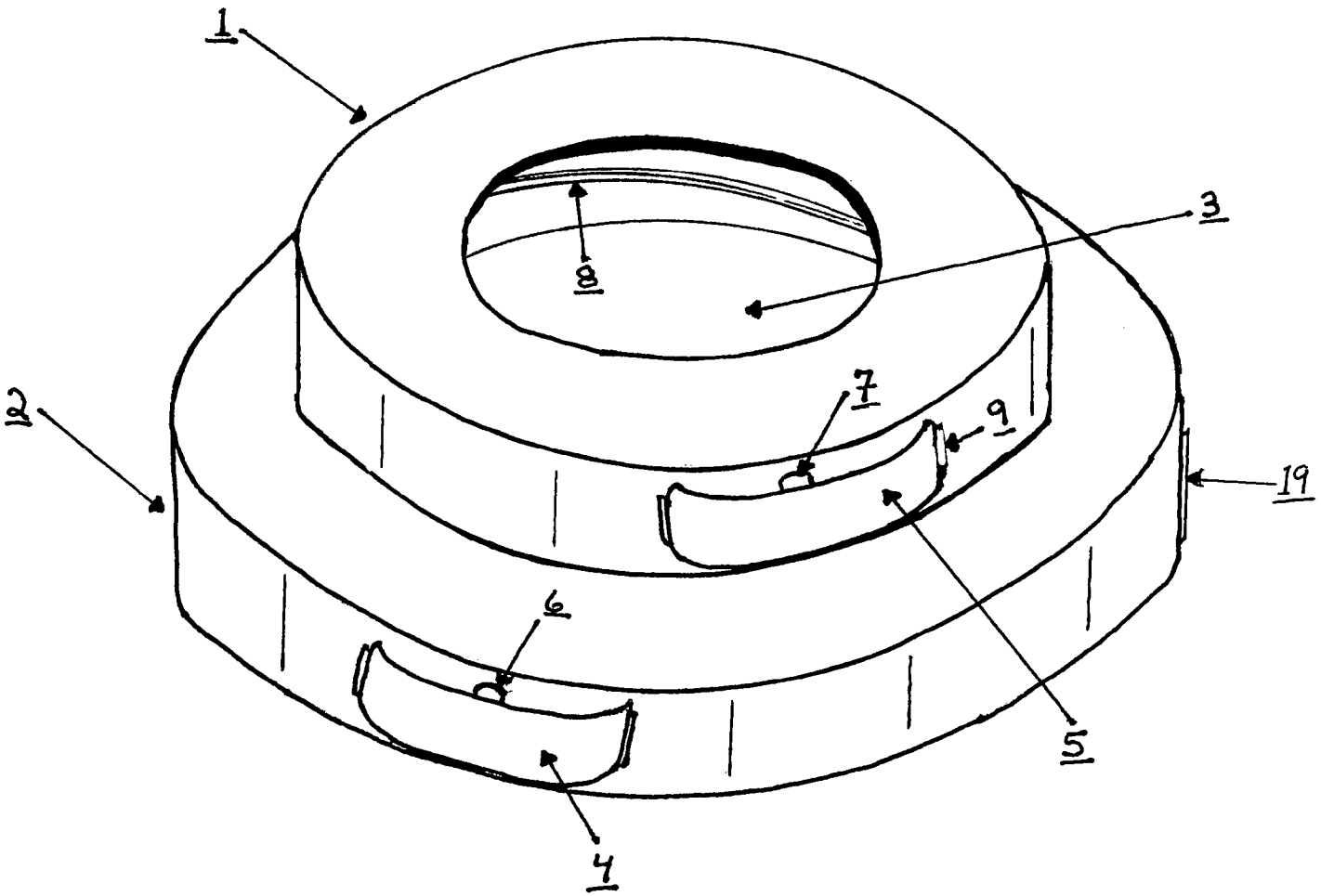
FIG. 1 is a perspective drawing, viewed from the top, front of the E-Z Lid Lifter that gives the best overall.
Figure 2:
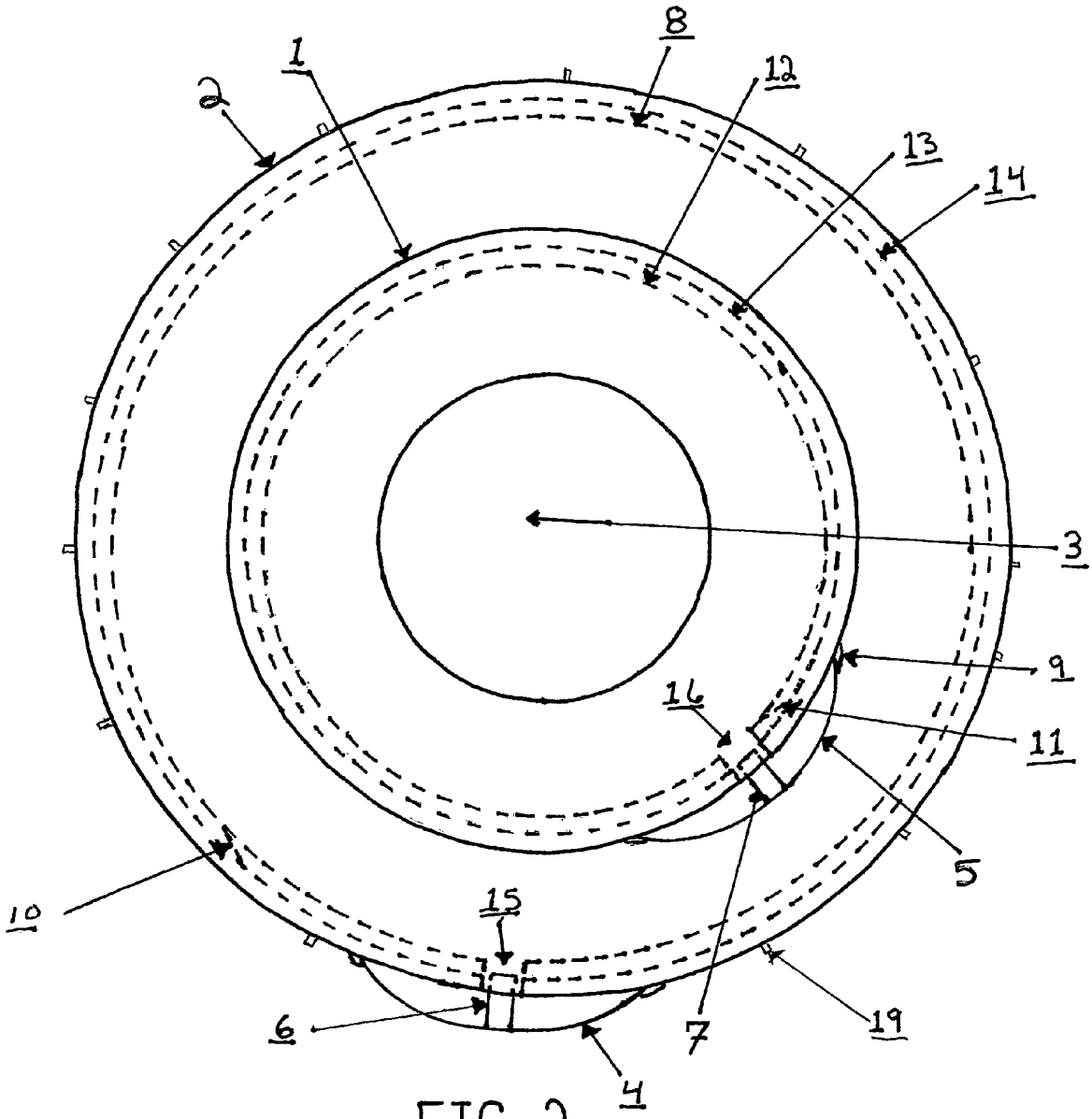
FIG. 2 is a top view of the E-Z Lid Lifter that shows more of the interior and the lifting pin/leaf spring assemblies.
Figure 3:
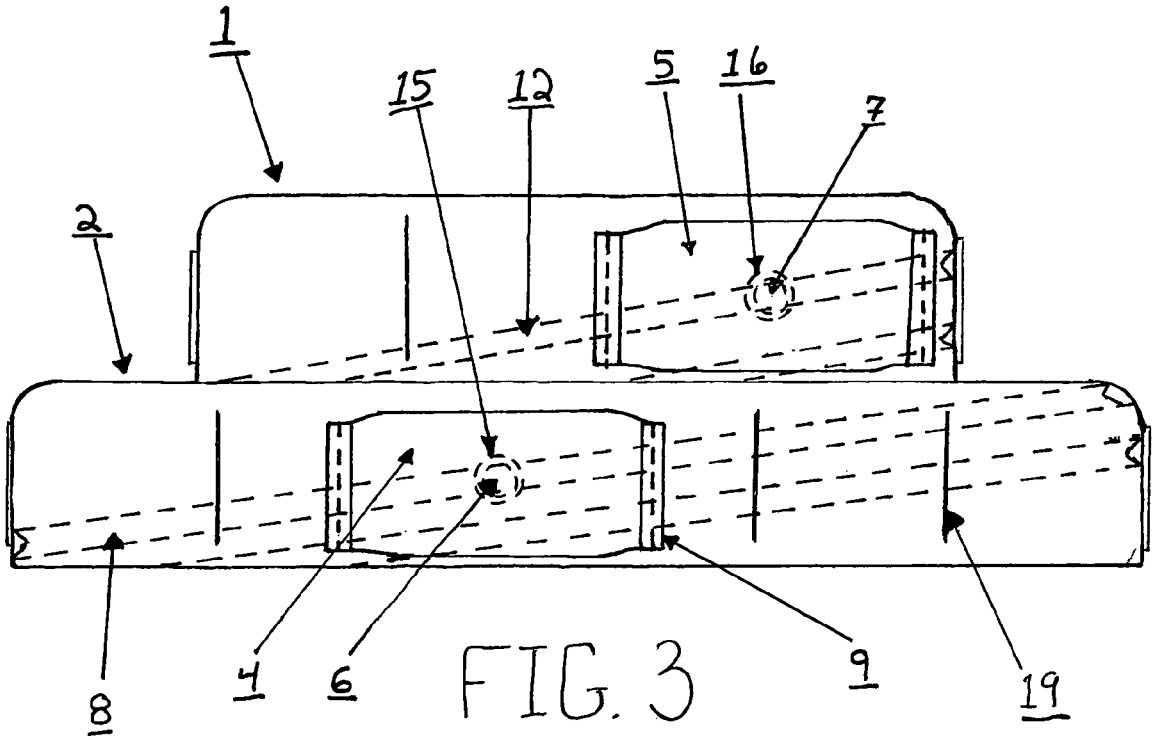
FIG. 3 is a front view, showing the lifting pin/leaf spring assemblies.
Figure 4:
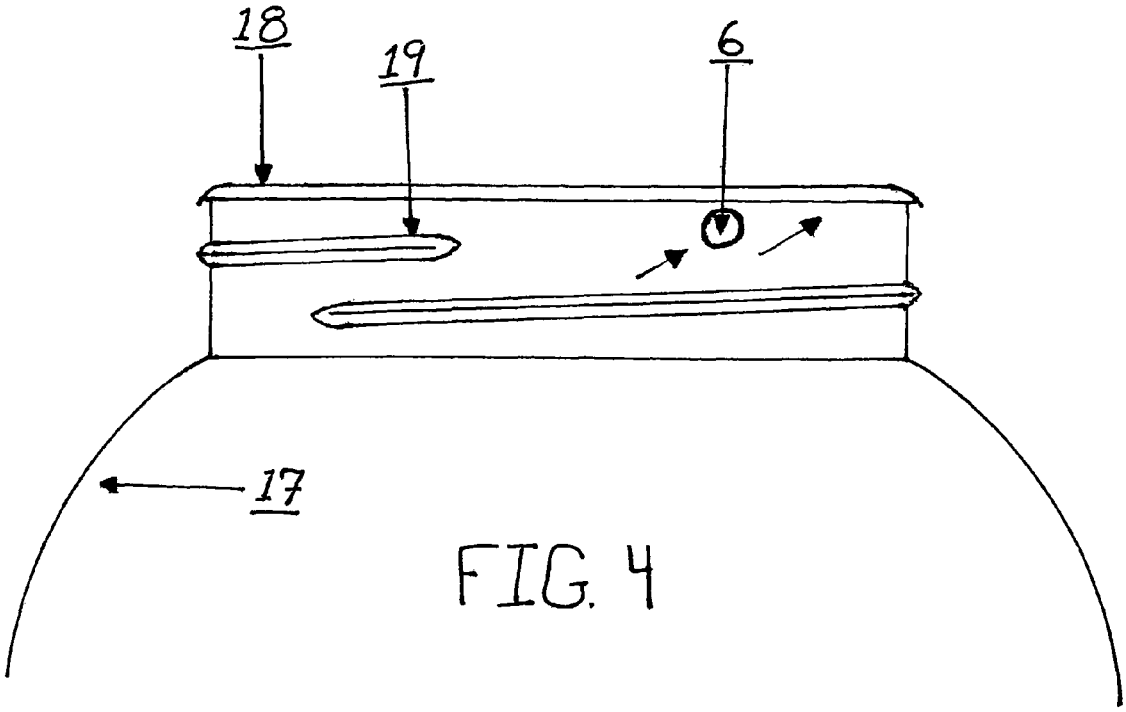
FIG. 4 is of a sealed, wide mouth Mason jar with the dome lid and a lifting pin, demonstrating that the lifting pin is moving counterclockwise and upward, lifting the dome lid and breaking the seal.

In order to operate the E-Z Lid Lifter the User simply screws the E-Z Lid Lifter onto a sealed Mason jar, the regular mouth jar will fit up inside of the lower portion of the body (1) which is hollow, into the upper portion of the body (2). At this point the User will depress the leaf (5) which will in turn insert the lifting pin (7) in, underneath the lip of the dome lid, as the dome lid has a lip that extends over the side of the Mason jar, as depicted in FIG. 4 (dome lid #18). The User then continues to hold/depress the leaf spring (5)/lifting pin (7) assembly and unscrews the body (1&2). As the threads of the body (1&2) ride upward on the threads of the Mason jar (19) and the lifting pin (7) rotates counterclockwise and upward, lifting the dome lid, breaking the vacuum seal between the dome lid and the Mason jar, thus opening the jar.

The leaf springs (4&5) then retracts the lifting pins (6&7) after they have been released and after the opening of the Mason jar, the user will hear the tell-tail hissing sound when the seal is broken.

The process works the same for both the upper and lower portion of the E-Z Lid Lifter body on both regular and wide mouth Mason jars.

Both the upper and lower portion of the body have vertical friction ribs (19) that assist in achieving a positive grip on the E-Z Lid Lifter.

NUMERICAL DESCRIPTION LIST

1) Upper portion of the E-Z Lid Lifter body
2) Lower portion of the E-Z Lid Lifter body
3) Finger hole (1½ inches diameter)
4) Lower leaf spring (1½ inches long and ½ inch wide)
5) Upper leaf spring (1½ inches long and ½ inch wide)
6) Lower lifting pin (3/16 inch diameter and 3/16 inch long)
7) Upper lifting pin (3/16 inch diameter and 3/16 inch long)
8) Threads of the lower portion of the body
9) Support ridges
10) End of threats of lower portion of body
11) End of threats of upper portion of body
12) Threads of the upper portion of body
13) Inside wall of upper portion of body
14) Inside wall of lower portion of body
15) Hole for lifting pen in lower portion of body (13/64 inch diameter)
16) Hole for lifting pen in upper portion of body (13/64 inch diameter)
17) Wide mouth Mason jar
18) Metal dome lid
19) Friction grips

The invention claimed is:

1. A device for removing sealed dome lids from both a regular mouth type Mason jar and a wide mouth type Mason jar, the device comprising:

a unitary body having an upper portion and a lower portion, said upper portion having an opening configured for receiving a regular mouth type Mason jar, said lower portion having an opening configured for receiving a wide mouth type Mason jar, and both said upper portion and said lower portion including internal threading for engaging a respective jar;

at least one hole positioned through a side of each of said upper portion and said lower portion; and, at least one lifting pin and spring assembly for each said hole, wherein said lifting pin is positioned through said at least one hole for selective contact with the jar and said spring biases the lifting pin with respect to said upper and lower portions of the body;

whereby, upon placing the device onto a sealed Mason jar, a user presses and holds the lifting pin inward such that said lifting pin is depressed inward lightly against the jar and under the lip of the dome lid, whereupon unscrewing of the device causes the body to rise upon the threads of the jar, the lifting pin to slide along the underneath lip of the dome lid, lift the dome lid, and thus break the seal and open the jar.

2. The device of claim 1, wherein said body includes a top portion having a hole therein configured to facilitate removal of an inadvertently trapped dome lid from the device.

* * * * *